United States Patent [19]

Gaudelli et al.

[11] 4,228,985

[45] Oct. 21, 1980

[54] APPARATUS FOR PRODUCING MOLDED CONCRETE PRODUCTS

[76] Inventors: Edmond N. Gaudelli, 2438 Payson Ave., Pittsburgh, Pa. 15220; Edward E. Shepler, 1733 Potomac Ave., Dormont, Pa. 15216

[21] Appl. No.: 877,892

[22] Filed: Feb. 15, 1978

[51] Int. Cl.[2] ..... B28B 7/08; B28B 7/18; B28B 7/24

[52] U.S. Cl. ..... 249/93; 249/120; 249/122; 249/129; 249/131; 249/137; 249/160

[58] Field of Search ..... 249/64, 91, 93, 120, 249/122, 124, 129, 130, 131, 137, 142, 143, 160

[56] References Cited

U.S. PATENT DOCUMENTS

| | | | |
|---|---|---|---|
| 838,737 | 12/1906 | Moore | 249/143 X |
| 884,931 | 4/1908 | Keogan | 249/137 |
| 885,539 | 4/1908 | Smith | 249/142 |
| 1,111,808 | 9/1914 | Sheldon | 249/120 |
| 1,166,770 | 1/1916 | Latham | 249/137 X |
| 1,968,189 | 7/1934 | Bartels | 249/137 X |
| 1,984,564 | 12/1934 | Blackmann | 249/137 X |
| 2,060,246 | 11/1936 | Russell | 249/142 X |
| 2,190,801 | 2/1940 | Otto | 249/142 X |
| 2,979,801 | 4/1961 | Gasmire | 249/91 X |

FOREIGN PATENT DOCUMENTS

| | | | |
|---|---|---|---|
| 138224 | 9/1948 | Australia | 249/131 |

*Primary Examiner*—Jan H. Silbaugh

[57] ABSTRACT

A mold bed having a number of longitudinal mold cavities is surrounded by a reinforcement structure which permits the mold bed to be handled as a unitary product. Mold cavities have removable end walls, one at each of opposite ends, to promote releaseability of the product from the mold cavities once they are removed. The mold cavity has a trunnion, one at each of opposite ends of the mold body so that the mold body can be rotated from an upright position when it receives the concrete in the mold cavity to an upside down position whereby the products are removed of their own weight. Two transverse spaced channel straps extend across the open face of the cavity so that when the mold bed is turned upside down, the molded parts are held temporarily by the mold straps, which are then released by unbolting their connections with the mold bed. A fork-lift truck removes the molded parts ater the mold straps are removed. Cores are formed by inserts which extend through openings in the channel straps and are aligned with openings in the bottom of the cavities which promote release of the cores.

A removable positioning means locates reinforcement rods at a proper location within the cavity during a pour. After the pour, the positioning means are then removed and the rod remains in place.

5 Claims, 7 Drawing Figures

FIG. 5
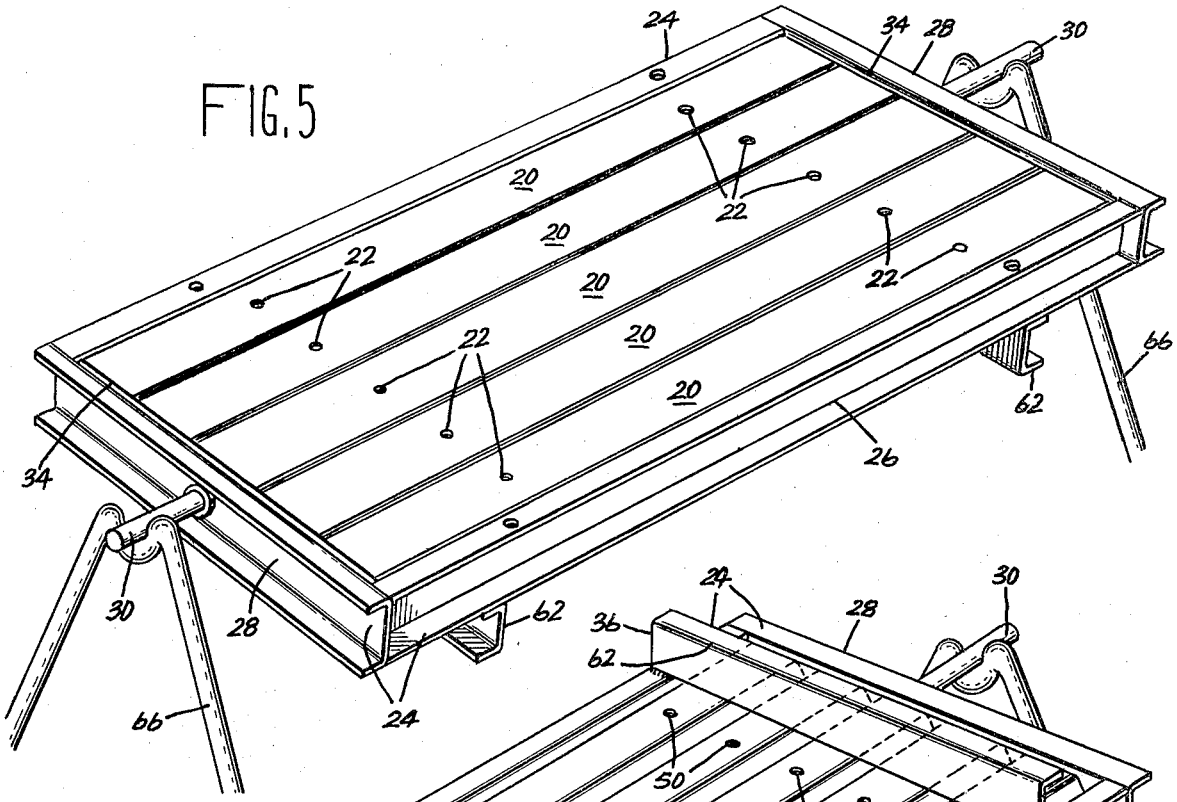
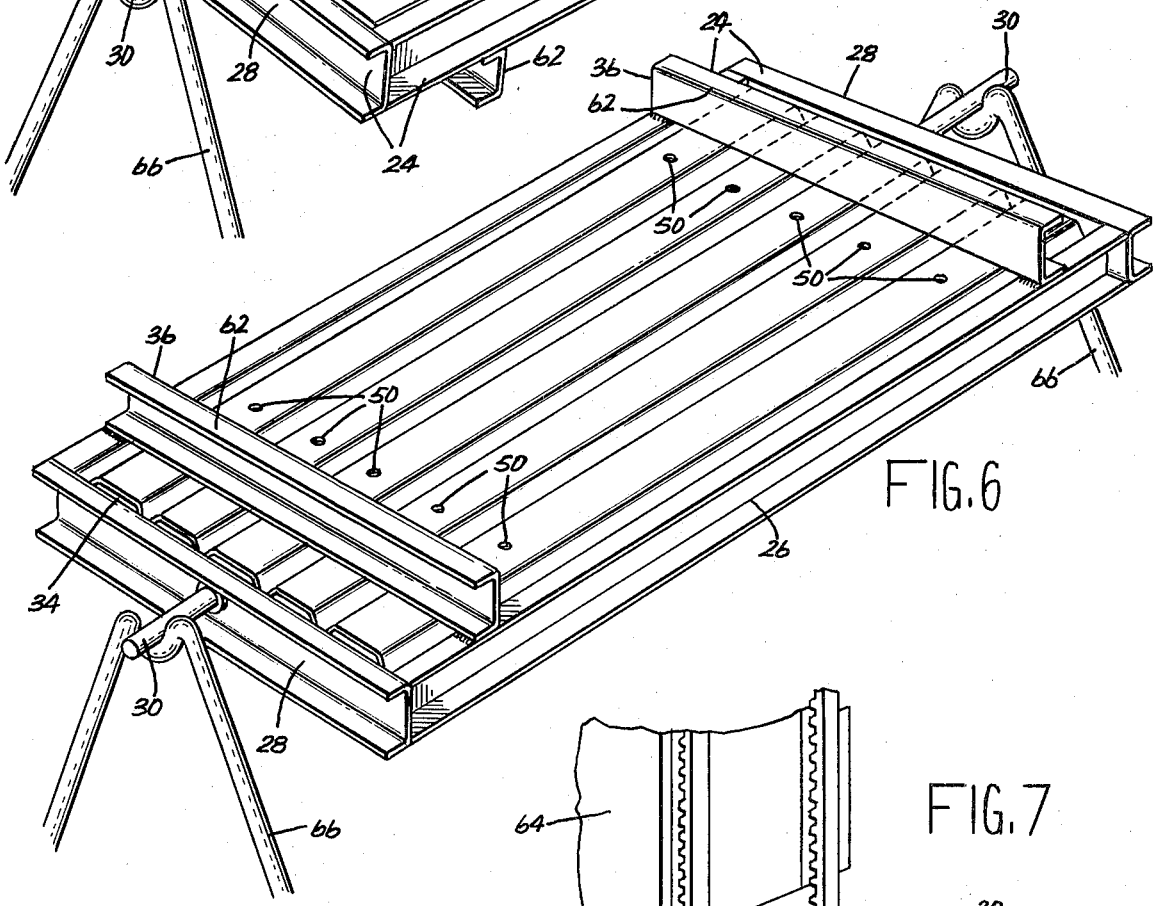
FIG. 6
FIG. 7
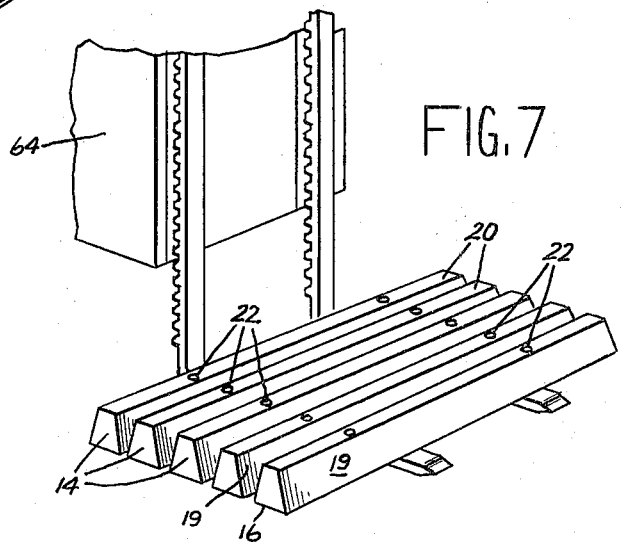

APPARATUS FOR PRODUCING MOLDED CONCRETE PRODUCTS

BACKGROUND OF THE INVENTION

In the process of making molded parts from reinforced concrete, the molds are large and cumbersome to handle. Usually, the molded parts are made one at a time, and do not lend themselves to machine operation. Typically, the parts are made by hand, the mold tipped, and the finished molded part then removed from the cavity. Many reinforced concrete molded parts are of standard size and are made in considerable quantity. For example, concrete spacers for use in parking lots are used in considerable quantity, are of standard size and construction, and are bolted in place on a parking lot to designate location and stops for parked cars. These components are made by hand; efforts to make such parts in quantity by efficient machine operation are now unsuccessful.

What is needed, is an apparatus and a method for making a number of these parking locators and other such large production standard parts in substantial quantity and with minimum manual effort. Thus, if it is possible to cast a number of these parts all at the same time, and with the reinforcements properly located, it would be possible to improve the efficiency of manufacture and reduce greatly the cost of per-unit manufacture.

SUMMARY OF THE INVENTION

It is a principal object of the present invention to provide a mold bed having a number of mold cavities in which there can be simultaneously formed concrete reinforced molded products. The reinforcement rods for the product are precisely located, are held in proper place during the pour to become fixed in proper reinforcement position while the locating means is withdrawn. There is no foreign residue left within the molded product.

Another object of the present invention is to provide an improved mold bed in which at least two of the walls are removable before the molded product is removed in order to prevent the occurrence of vacuum which otherwise tends to retain the molded part within the cavity resisting its removal. In this way, the molded parts are more rapidly removable; there is less likelihood of damage to the product in the process of its removal.

Another object of the present invention is to provide an improved mold bed in which there are a number of mold cavities. When all of the mold cavities are properly filled with concrete and are hardened and are ready for removal, the entire mold bed is trunnion mounted and turned upside down so that the molded parts will fall of their own weight out of the cavity. The mold bed is so precisely balanced by means of trunnions at the opposite ends of the bed that the mold bed, together with its contents, is easily raised onto bearings which receive the trunions, and it is then possible to manually turn the mold bed to effect removal of the molded parts, which simply drop from the respective mold cavities of their own weight.

Another object of the present invention is to hold, temporarily, the molded parts before they drop completely out of their mold cavity, by means of two straps which extent transversely at spaced locations on the mold bed and which hold the molded parts until a fork-lift truck, or other conveyancing means, can be raised into position to receive the molded parts. The load of the finished parts then transfers from the straps to the fork-lift truck by decoupling the bolted connections of the straps with the reinforcing members of the mold bed.

Another important object of the present invention is to locate precisely cores in the mold cavities to make mold openings in the finished parts through which fasteners or the like are passed to hold the molded part in place. Location of the openings in the finished parts are accomplished by means of cores passed through aligned openings in the straps and extending through the mold cavity into contact with complementary openings at the bottom of the mold cells, or mold cavities, so that after the molding is completed, such cores can be removed. The openings in the bottom of the mold cavities will prevent occurrence of vacuum to resist such removal. Once the cores are removed, a through passage remains in the molded product.

An overall object of the present invention is to provide a consistently uniform reinforced concrete molded product which can simultaneously be made in quantities of 5, 6, 7, or whatever number is desired depending upon the number of mold cavities in the mold bed. The molded parts, according to the present invention, are readily removable because the mold bed, after the bed is turned upside down, tends to eject the molded parts of their own weight. Yet such molded parts are not expelled suddenly, but, instead, are held temporarily by mold straps which extend across the mold bed, the straps being then removed to transfer the weight to the forks of a fork-lift truck. Thus, the rate of manufacture of these molded components can be greatly improved and manual handling of the mold bed is minimal.

As described, the molded parts are not "hung" in the molds, because likelihood of occurrence of vacuum to retard release of the products is minimal.

Other objects and features of the present invention will become apparent through a consideration of the following description, which proceeds with reference to the accompanying drawings wherein an example embodiment of the invention is explained.

DRAWINGS

FIG. 5 illustrates the mold bed partially tipped and with the end walls removed;

FIG. 6 illustrates the mold bed fully inverted, or turned 180° from its original position on the trunnion mounting;

FIG. 7 illustrates the brackets removed and the forks of a fork-lift truck lowering the molded parts.

DETAILED DESCRIPTION OF THE INVENTION

Figure 1:
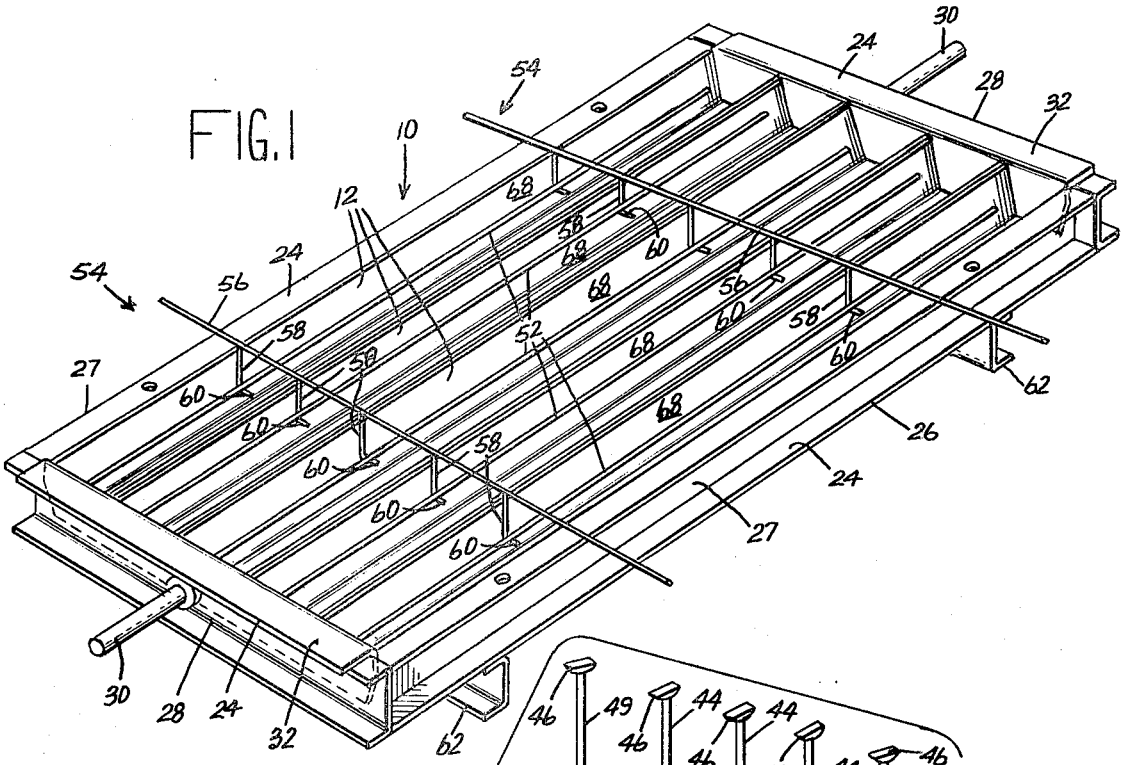
FIG. 1 is an isometric detail view of the mold bed.
Figure 2:
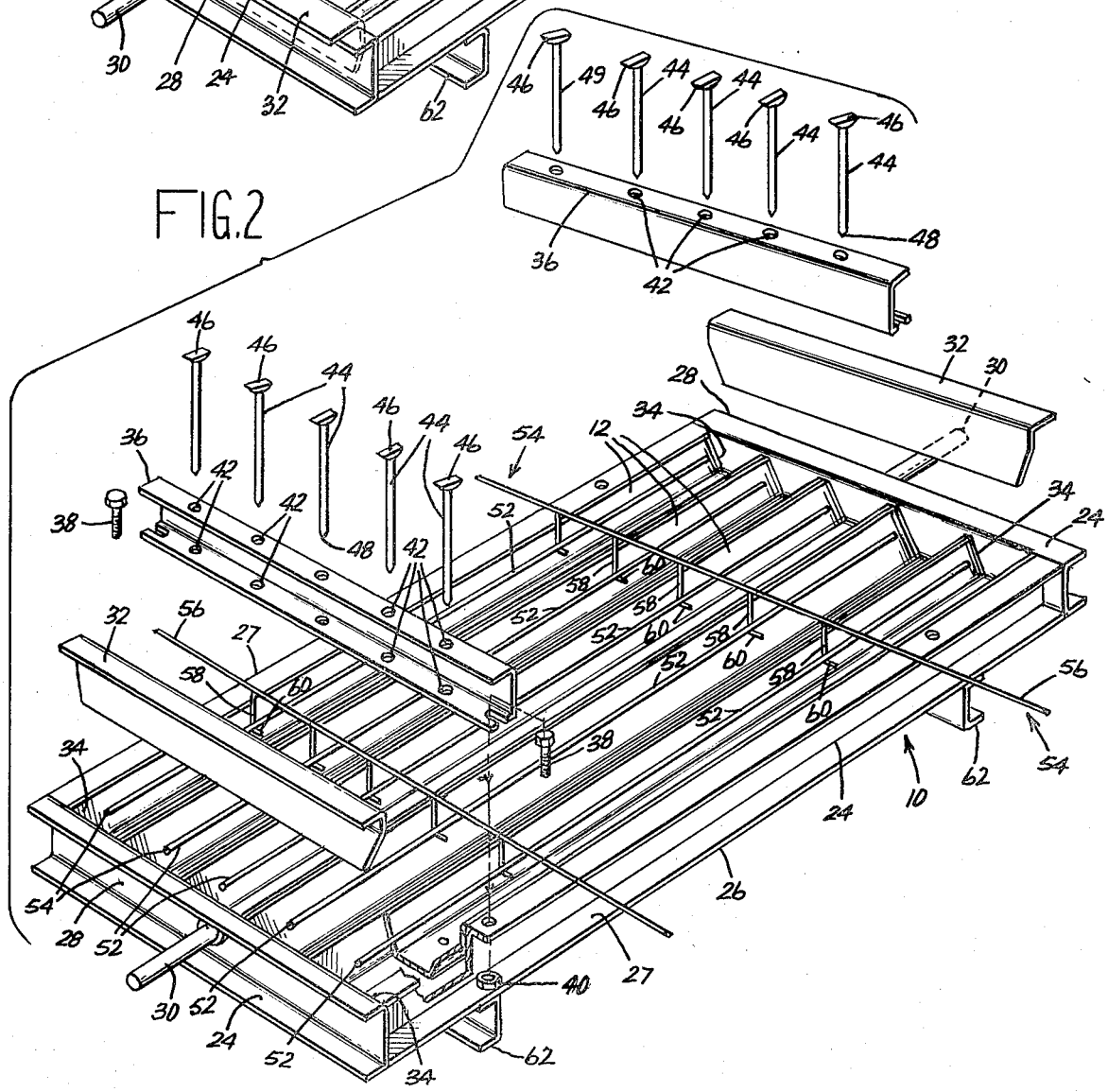
FIG. 2 is an isometric exploded view illustrating how the end walls, channel brackets, cores, and reinforcing rod locaters are located relative to the mold bed.

A mold bed designated generally by reference numeral 10 includes a number of identical mold cavities 12, there being five such cavities in the illustrated mold bed.

The cross-section of the mold cavity corresponds to the cross-section of the part being cast and the cavity determines the outer dimensions of the component being made, in this case a parking lot locater 14. The parking lot locater has a base 16, flat side 18, inclined sides 19, and a top 20. There are generally two through openings 22 which receive bolts used to hold down the locater 14 and designate marked spaces for parking. It should be understood at this juncture that the invention, including apparatus and process, is in no way limited to a particular part being made. There is equally included within the scope of the present invention, manufacture of reinforced concrete components such as beams, colums, and the like, and other such structural components which are useful in the building arts.

Returning now to the apparatus, the mold cavities 12 are surrounded by reinforcement members 24 which form a rigid outer frame 26. Typically, these reinforcement beams 24 are welded together with each end beam 28 having a trunnion 30, the purpose of which is to pivotally support the mold bed. Between end beams 28 and the mold cavities are removable end walls 32 proportioned to fit within slots 34 provided between the endmost part of the cavities and the confronting end beams 28. The end walls are removable in order to break any vacuum which might tend to retain the finished molded parts within the mold cavities after the molded parts are hardened sufficiently for removal.

There are two channel brackets 36, each spaced about 15% of the total length of the mold cavity from a respective end beam 28. The brackets are removably bolted by means of bolts 38 and nuts 40 to the side beams 27 which are part of the frame 26. Each bracket 36 has aligned openings 42 therein, the purpose of which is to receive inserts 44 (sometimes referred to as "cores"). The inserts 44 have handles 46 and ends 48 which intersect with openings 50 at the bottom of each mold cavity. The purpose of the opening in the bottom of the mold cavity is to facilitate removal of the insert, or core, pieces 44 after the cavities are filled with concrete and the molded articles are sufficiently hardened and ready for ejectment from the mold cavities. These openings 50 prevent any occurrence of vacuum and facilitate removal of each core manually by means of the handle 46.

Within each mold cavity is located one or more longitudinal reinforcement rods 52. In previous installations, these rods were simply laid in the bottom of the cavity, and then an attempt was made to pull them up through the uncured concrete with the hope that they would be located at some central point, or other preferred location, within the uncured concrete, and stay in that location in the finished, cured part for its reinforcing function. This obviously resulted in hit-and-miss type constructions. In the present invention, each rod 52 is held by a locator 54 having a series of depending arms 58, each arm terminating in a hook 60. The reinforcement rod 52 is held on the spaced hooks 60, at a preferred location relative to the mold cavities so that the hooks 60 maintain the associated reinforcement rod at the proper depth. Typically, the reinforcement rod is held against the core or inserts 44 so that the reinforcement rod is held centrally in relation to the cross-section of the molded part and is approximately tangent to the through opening which is formed in the molded reinforced concrete product, such opening being developed by the core, or insert, 44.

Figure 3:
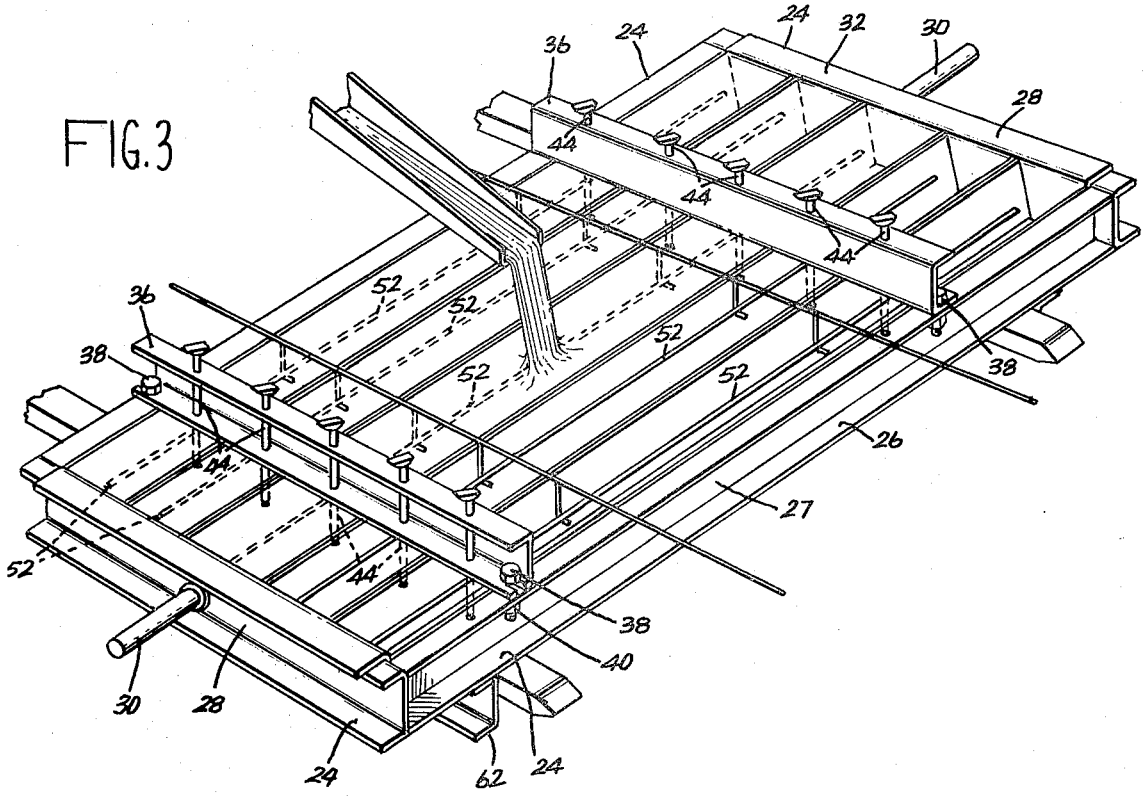
FIG. 3 illustrates the components in place and during a pour.
Figure 4:
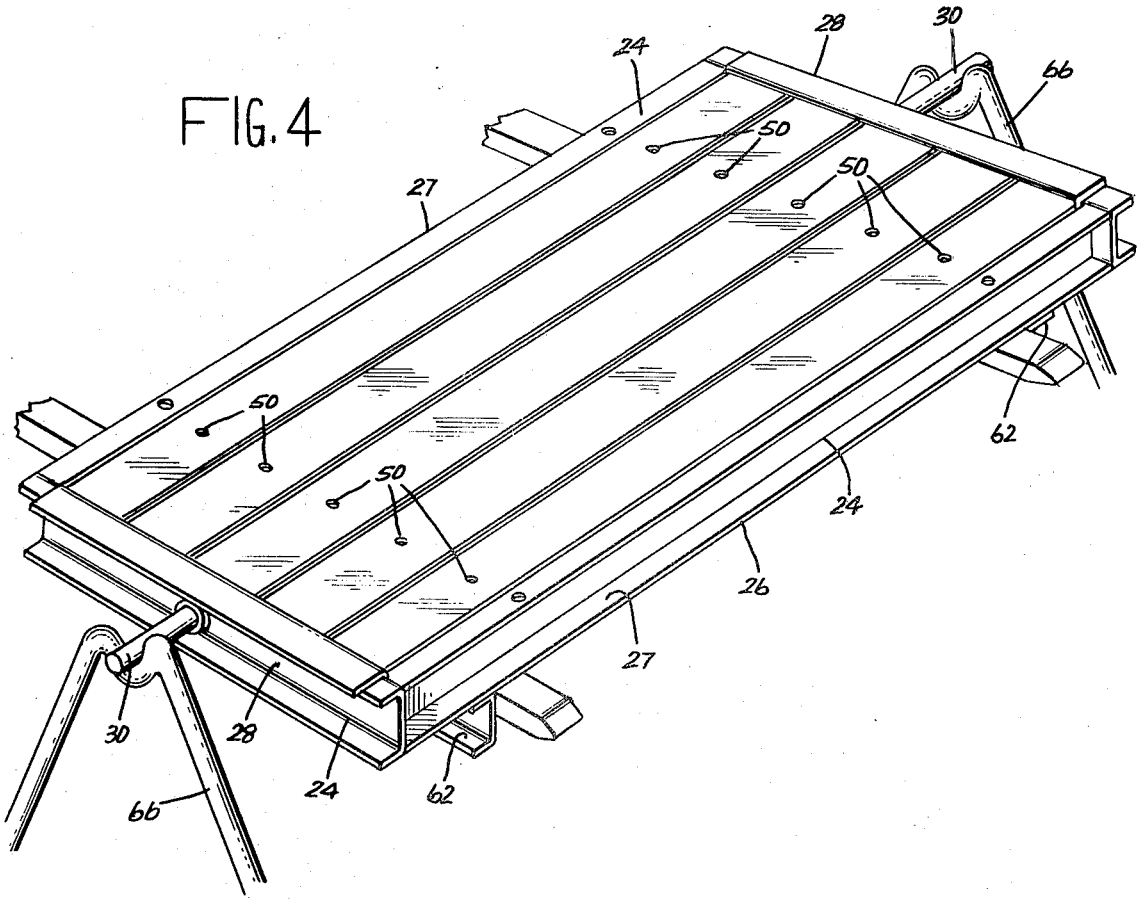
FIG. 4 illustrates the mold bed as it is positioned by the trunnions on the bearings and in readiness for ejection of the molded parts.

As illustrated in FIG. 3, after the concrete is poured into the cavities, the reinforcement rod is in a proper embedded position, and it will maintain its position, "floating" within the uncured concrete at the correct depth. The hooks 60 are then disengaged by displacing the pole 56 longitudinally until the hooks are disengaged from the reinforcement rods, and the arms 58 and hooks 60 are collectively withdrawn from the concrete by first displacing the pole 56 longitudinally and then extracting the hooks 60 and arms 58 from the wet, uncured concrete, leaving no residue within the concrete.

At the bottom of the mold bed are a number of reinforcement channels 62 which prevent bending of the mold cavity and its contents when it is lifted by a fork-lift truck 64 to place the trunnions on their support-bearing surfaces provided by pedestals 66.

OPERATION

In operation, the inner surfaces 68 of the mold cavities are sprayed with a high paraffin content oil which is intended to provide a release between the molded part and the mold cavity walls.

The pole 56, together with arms 58 and hooks 60, receives a reinforcement rod 52 which is positioned so that when the pole is laid with its ends resting on the upper surface of the mold bed, the reinforcement rod 52 is located at the correct depth within each respective mold cavity. The two channel brackets 36 are then bolted in place and each of the inserts 44 is passed through the aligned openings 42 in the channel brackets 36. The mold cavity is now ready for receiving concrete and each of the mold cavities is filled, or substantially filled, with concrete of the appropriate sand, cement, gravel, water, ratio, and a pencil vibrator (not shown) is used to vibrate the concrete so that no voids will occur within the mixture. The concrete within the mold cavities is then allowed to set, generally 8 to 14 hours, and the mold bed, together with its contents, is then lifted by means of a fork-lift truck, and placed so that the trunnions are received within companion bearings of pedestal 66 and the end walls are then removed. The inserts 44 are next removed by gripping the handles 46 and extracting them from the finished part. The openings 50 "break" any vacuum, facilitating removal of the inserts 44.

While the cement is still fluid, the pole 56, together with the depending arms 58 and hooks 60, is displaced sufficiently to disengage with the reinforcement rod 52, and the pole 56, arms 58, and hooks 60, are longitudinally displaced to disengage hooks 60 from rod 52 and then drawn upwardly through the wet concrete while the reinforcement rod 52 stays in position.

After removal of the end walls and inserts 44, the mold bed is tilted on its trunnion either partially or through 180°, and the molded parts then fall downwardly and are supported temporarily by the channel brackets 36. A fork-lift truck is then brought into place with the forks extending across the face of the mold bed with the forks raised. The brackets 36 are then removed by loosening the nuts 40 from bolts 38, dropping the brackets 36, and transferring the load of the molded parts (which have now left the mold cavity), from the brackets 36 onto the forks of the fork-lift truck. The fork-lift truck then lowers the finished product sufficiently to clear the mold bed, and removes the molded products.

The mold bed is then returned to its upright position; is removed from the trunnion-bearing engagement provided by the pedestals and returned to ground level. The end walls are reinserted in place, the pole, together with arm and hooks and reinforcement rod thereon, are located in relation to the mold cavities so that the reinforcement rod(s) is (are) at the correct depth and spaced at the correct lateral position figured from side to side of the mold cavities. Next, the channel brackets 36 are bolted back in place; the inserts 44 are passed through the openings in the brackets 36 and the ends of the inserts 44 brought into engagement with the apertured portion 50 at the bottom of the mold cavities; and, the apparatus is then ready for the next pour.

As described, it should be clear that while products such as markers or locaters for parking lots are producible, the invention is by no means limited either by apparatus or by process, to that particular configuration of molded reinforced concrete product. Beams, columns, various structures useable in the building industry and road-building industry, are equally useable, and are all well within the teaching of the present invention.

Although the present invention has been illustrated and described in connection with a single example embodiment, it will be understood that this is illustrative of the invention and is by no means restrictive thereof. It is reasonably to be expected that those skilled in this art can make numerous revisions and adaptations of the invention and it is intended that such revisions and adaptations will be included within the scope of the following claims as equivalents of the invention.

What is claimed is:

1. An apparatus for producing a number of molded concrete products from a single molding apparatus, comprising a mold bed having a mold means forming a plurality of elongated mold cavities and elongated mold walls and having reinforcement means surrounding said mold means and forming therewith a unitary structure whereby said mold bed can be carried as a whole, removable end wall portions of said mold cavity which are interfittable between the ends of the mold walls and the adjacent reinforcing means and are removable from said position, bracket means overlying the upper surfaces of said mold cavities and extending traversely to said elongated mold cavities at spaced-apart locations thereof, means for releaseably clamping said transverse bracket members to said reinforcement means, insert means associated with said transverse bracket members and adapted to extend within respective ones of said mold cavities to intersect with an opening at the bottom of a respective one of said mold cavities, load-bearing means receiving complementary portions of said mold bed and adapted for rotational inverting of said mold bed by rotation about said load-bearing means after the molded products are sufficiently hardened, and thereby transferring the weight thereof to the transverse bracket means, said removable clamping means securing said transverse bracket means, and providing detachment of said transverse bracket means to allow for gravity separation of the finished products from within the respective mold cavities.

2. The apparatus in accordance with claim 1 including a longitudinal positioning means disposed at the upper level of said elongated mold cavities and having reinforcement rod support means at the ends thereof, said support means adapted to receive a reinforcement rod which is held at a predetermined location within said mold cavity until the cavity is filled, and means for thereafter removing said positioning means whereby the reinforcement rod is suspended within the uncured concrete at a preferred location therein.

3. The apparatus in accordance with claim 1 including a pair of trunions, one at each of opposing ends of said mold bed, bearing means adapted to receive said trunions whereby said mold bed can be rotated from a first position wherein concrete is held within the mold cavities to a second position in which the mold bed is turned upside down and the molded contents are controllably released from the mold cavities by their own weight.

4. The apparatus in accordance with claim 1 in which the insert means are located in said traverse bracket members and are coaxially disposed with a complementary opening at the bottom of said mold cavities and into which said insert means are moved for perpendicular disposal within siad mold cavities, the ends of said insert means being in registry with respective openings at the bottom of said mold cavities for convenient removal from said molded product.

5. The apparatus in accordance with claim 1, including traverse strengthening means supporting elongated mold cavities at the undersurface of said mold bed to reinforce said mold cavities against distortion as said mold bed is handled together with its molded contents.

* * * * *